US009901241B2

(12) United States Patent
Jerg et al.

(10) Patent No.: US 9,901,241 B2
(45) Date of Patent: Feb. 27, 2018

(54) DISHWASHER, IN PARTICULAR DOMESTIC DISHWASHER, COMPRISING AT LEAST ONE GUIDE STRUCTURE ON THE INNER FACE OF THE DOOR THEREOF FOR DEFLECTING DRYING FLUID FLOWING ALONG THEREFROM

(71) Applicant: BSH Bosch und Siemens Hausgeräte GmbH, Munich (DE)

(72) Inventors: Helmut Jerg, Giengen (DE); Hans-Peter Nannt, Gerstetten (DE); Michael Georg Rosenbauer, Reimlingen (DE)

(73) Assignee: BSH Hasugeräte GmbH, Munich (DE)

( * ) Notice: Subject to any disclaimer, the term of this patent is extended or adjusted under 35 U.S.C. 154(b) by 502 days.

(21) Appl. No.: 14/407,082

(22) PCT Filed: Jun. 21, 2013

(86) PCT No.: PCT/EP2013/062988

§ 371 (c)(1),
(2) Date: Dec. 11, 2014

(87) PCT Pub. No.: WO2014/005857

PCT Pub. Date: Jan. 9, 2014

(65) Prior Publication Data

US 2015/0157186 A1 Jun. 11, 2015

(30) Foreign Application Priority Data

Jul. 4, 2012 (DE) ..... 10 2012 211 627

(51) Int. Cl.
*A47L 15/42* (2006.01)
*A47L 15/48* (2006.01)

(52) U.S. Cl.
CPC ..... *A47L 15/48* (2013.01); *A47L 15/4257* (2013.01); *A47L 15/481* (2013.01); *A47L 15/483* (2013.01); *A47L 15/486* (2013.01); *A47L 15/488* (2013.01)

(58) Field of Classification Search
CPC .... A47L 15/4257; A47L 15/48; A47L 15/481; A47L 15/483; A47L 15/486; A47L 15/488
(Continued)

(56) References Cited

U.S. PATENT DOCUMENTS

2008/0202557 A1 8/2008 Gonska et al.
2008/0264458 A1 10/2008 Berner et al.
(Continued)

FOREIGN PATENT DOCUMENTS

DE 10257650 A1 6/2004
EP 1825800 B1 4/2013
GB 1515095 6/1978

OTHER PUBLICATIONS

National Search Report CN 201380035174.
International Search Report PCT/EP2013/062988 dated Apr. 17, 2014.

*Primary Examiner* — Levon J Shahinian
(74) *Attorney, Agent, or Firm* — Micahel E. Tschupp; Andre Pallapies; Brandon G. Braun

(57) ABSTRACT

A dishwasher, in particular a domestic dishwasher, including a washing compartment, at least one washing basket disposed in the washing compartment to hold items for washing, and a door configured to close the washing compartment. The door has a planar surface to form an inner face of the door as a whole or a part thereof. When the door is closed, a guide structure including a plurality of individual guide elements projects in a raised manner from the planar surface into an interior of the washing compartment and is disposed so as to guide a drying fluid flowing along the inner
(Continued)

face of the door onto the items in the washing compartment, when the dishwasher is in drying mode.

28 Claims, 5 Drawing Sheets

(58) Field of Classification Search
USPC ..... 134/56 D, 57 D, 58 D, 95.2, 102.3
See application file for complete search history.

(56) References Cited

U.S. PATENT DOCUMENTS

| | | | | |
|---|---|---|---|---|
| 2009/0038661 | A1* | 2/2009 | Hildenbrand | A47L 15/483 134/56 D |
| 2009/0151758 | A1* | 6/2009 | Kristensson | A47L 15/507 134/201 |
| 2010/0083991 | A1 | 4/2010 | Tolf | |
| 2011/0120511 | A1 | 5/2011 | Jerg et al. | |
| 2011/0120512 | A1 | 5/2011 | Delle et al. | |
| 2011/0197926 | A1* | 8/2011 | Fauth | A47L 15/4291 134/18 |

* cited by examiner

DISHWASHER, IN PARTICULAR DOMESTIC DISHWASHER, COMPRISING AT LEAST ONE GUIDE STRUCTURE ON THE INNER FACE OF THE DOOR THEREOF FOR DEFLECTING DRYING FLUID FLOWING ALONG THEREFROM

BACKGROUND OF THE INVENTION

The invention relates to a dishwasher, in particular a domestic dishwasher.

It comprises a washing compartment, in which one or more washing baskets serving to hold items for washing are present. For the purposes of loading and unloading the items for washing the dishwasher has a door, in particular a front door, which can be used to close the washing compartment. To improve the drying of damp items for washing that have been treated with rinse liquid after a cleaning cycle, a dishwasher with a drying system is used, in which drying fluid in the form of air is made to flow so that it flows around the items for washing, thereby absorbing moisture and releasing said moisture again at a different point, where a liquid-absorbing material, for example zeolite material, or a cooling surface is present. The flow of the drying fluid can be in particular a convection flow or a forced flow, produced for example by a fan. With some designs of dishwasher with a front door it can come about that a free space or peripheral gap is present between the inner wall facing the interior of the washing compartment, in other words the inner face of the front door, and the front of a washing basket accommodated in the interior of the washing compartment, through which free space or peripheral gap some of the circulating drying fluid flows along the inner face of the door, in particular in the heightwise direction of the interior of the washing compartment so that drying fluid flowing along there comes into contact at most only to some degree, in other words in a limited fashion or barely, with the items for washing that are held in one or more washing baskets in the interior of the washing compartment and can therefore absorb no moisture or at least less moisture than is the case with a drying fluid flow that strikes the surface of the items for washing directly, for example when it flows to the lower or upper face of the washing basket, preferably in the center.

BRIEF SUMMARY OF THE INVENTION

The object of the invention is to provide a dishwasher, in particular a domestic dishwasher, with an improved drying performance.

With a dishwasher of the type mentioned in the introduction this object is achieved in that when viewed with the door in the closed position at least one guide structure, in particular in the form of a number or plurality of individual guide elements, projects in a raised manner from an essentially planar or flat surface of its door inner face and is disposed in such a manner that when the dishwasher is in drying mode a drying fluid flowing along the inner face of the door is guided to a washing basket accommodated in the interior of the washing compartment or onto items for washing disposed thereon. The planar surface forms either the entire inner face of the door or a part thereof. The former is the case with a door that does not have an inner face recessed in the manner of a trough, the inner face being formed by a planar sheet metal part or cut sheet metal or a plate made of glass or plastic for example. The latter applies in the case of a door, the inner face of which has a trough-type recess delimited by a peripheral bead.

The inner face of the door is formed in particular by the wall of the so-called inner door of the door facing the interior of the washing compartment (when viewed with the door in its closed position). The door is preferably configured as a front door, which can be used to close a front opening of the dishwasher for loading and/or unloading the interior of the washing compartment.

The drying fluid is preferably air, which is not however saturated with water vapor and can therefore absorb moisture.

The guide structure projecting from the planar surface of the inner face of the door, in particular the number of projecting guide elements, means that when the front door is closed any free space or peripheral gap between said planar surface of the door and the front faces of one or more washing baskets disposed in the washing compartment is narrowed. The drying fluid flow, which in a preferred dishwasher preferably flows through a correspondingly configured circulating apparatus along the heightwise extension of the inner face of the door, in particular from bottom to top, meets a guide structure, in particular a number of guide elements, which force on it a horizontal direction component in the direction of the interior, in particular onto specific inner regions of the washing chamber of the washing compartment, in other words a drying fluid flow results which is directed away to the rear into the interior of the washing compartment, in other words inward, specifically onto the items for washing held there in one or more washing baskets, unlike its original flow direction running in the heightwise direction of the door in the front peripheral gap. A diversion of the drying fluid flow directed away from the front door to the rear into the interior of the washing compartment naturally also results with guide elements positioned above or below said free space on the inner face of the door. The hitherto essentially unused portion of the drying fluid flow flowing along the inner face of the door in the front peripheral gap is now utilized according to the invention to dry the dishes, thereby improving the drying result or the drying performance of the dishwasher.

The guide structure, in particular its number of guide elements, is provided in particular in addition to, in other words extra to, one or more functional elements of the dishwasher already structurally present for the correct operation of the dishwasher, such as for example its dispenser unit for cleaning agent and/or rinse aid.

According to one advantageous development of the invention the guide elements forming a guide structure on the inner face of the door (when viewed in its closed position) are spaced vertically apart from one another. A largely planar or flat subsurface of the inner door wall of the door facing the interior of the washing compartment and a guide element that protrudes from said planar subsurface with a component in the depthwise direction of the interior of the washing compartment therefore alternate. Overall this produces a guide structure that ensures multiple, in particular staged, deflection of a drying fluid flow in the direction of the interior of the washing compartment with one or a number of washing baskets, while it flows in the heightwise direction of the door, in particular from bottom to top, along its inner face. Because the guide elements are disposed with an offset from one another in the heightwise direction of the door, parts or portions of the drying fluid flowing along the inner face of the door along its heightwise extension, in particular from bottom to top, can be deflected specifically at different heights from the inner face of the door in the direction of the interior of the washing compartment onto the items for washing that are held there in one or more washing baskets. This improves the drying of the items for washing in the drying cycle of a dishwasher program to be performed in each instance.

It is in particular expedient if the vertical distance between two adjacent guide elements (when viewed with the door in the closed position) in each instance is greater than the vertical extension of the respective guide element. Such dimensioning of the change from planar subsurfaces of the inner door wall of the door to guide elements additionally protruding therefrom produces a particularly effective spoiler effect or diffuser effect, allowing a drying fluid flow passing along the inner face of the door to be diverted specifically to predetermined regions in the interior of the washing compartment, in particular to the respective interior of the one or more washing baskets.

It has proven particularly favorable for a perfect drying result if a vertical distance of 1 cm to 10 cm, in particular 2 cm to 5 cm, is selected between two adjacent guide elements in each instance. The closer the guide elements are together, the shorter therefore their distance in the vertical direction, in other words their vertical distance, the smaller their diverting action, as downstream guide elements in each instance are as it were in the "wake" of the upstream adjacent guide element. Tests have shown that a minimum vertical distance of at least 1 cm between two adjacent guide elements in each instance is expedient in order to be able to bring about a desired diversion for the drying fluid flowing along the inner face of the door into the interior of the washing compartment by means of the respective guide element.

Between 2 and 8, in particular between 3 and 6, guide elements are expediently provided on the inner face of the door to form an effective guide structure.

It can in particular be expedient if the guide elements run essentially parallel to one another. This produces a regular guide structure, which can be implemented in a simple manner during the mass production of dishwashers. In particular such a guide structure can be shaped in a metal inner door wall by stamping, deep-drawing or by means of some other mechanical shaping process. The guide elements can also be positioned with a parallel orientation in relation to one another with the aid of another connecting method, for example bonding to the inner door wall. If the inner door wall is made of plastic, such a parallel orientation of the guide elements also favors their positioning or shaping.

According to one expedient development of the invention the respective guide element is advantageously configured in the form of a guide rib that extends in the widthwise direction of the door and is in particular linear. As the respective guide rib, which protrudes in the depthwise direction, lies across, in particular perpendicular to, the flow direction of the drying fluid flow, a baffle or spoiler is provided in a simple manner to deflect the drying fluid flowing along the inner face of the door and in particular rising in a heightwise direction in the direction of the interior of the washing compartment, in particular the items for washing held there in one or more washing baskets.

When viewed with the door in the closed position the respective guide element preferably has a vertical extension of 1 mm to 20 mm, in particular 3 mm to 12 mm In particular the one or more guide structures, in particular guide elements, each have a depthwise extension of 1 mm to 10 mm, preferably 3 mm to 7 mm, when viewed with the door in the closed position, protruding by this in each instance from the planar surface of the inner face of the door into the interior of the washing compartment, when viewed with the door in the closed position.

According to one advantageous variant the inner face of the door has a trough-type recess, said recess being delimited by a peripheral bead.

In general terms the depthwise extension of the one or more guide structures is preferably 2% to 20%, in particular 5% to 15%, of the depthwise extension of the peripheral bead of the door and/or a holding projection projecting from the planar surface of the inner face of the door and serving to hold a functional component.

It may be expedient for the inventive diversion or deflection of the drying fluid flow if 1% to 20%, in particular 2% to 10%, of the planar surface of the inner face of the door is covered by the at least one guide structure, in particular the guide elements.

It may be advantageous for an adequate deflection action if the one or more guide structures, in particular guide elements, extend over 50% to 90% of the width of the door.

In particular it may be adequate if the one or more guide structures, in particular guide elements, are only disposed in the lower two thirds of the inner face of the door. This ensures that drying fluid flowing along the inner face of the door can be diverted into the interior of the washing compartment in a timely manner before reaching the top wall of the washing compartment. In particular it is thus possible for the drying fluid to be guided onto the bottom surface of an upper washing basket accommodated in the interior of the washing compartment, for example an upper rack or a flatware drawer, so that drying fluid can flow up from below to said upper washing basket and through it.

It may be particularly favorable if the one or more guide structures, in particular guide elements, are only disposed on a surface region of the inner face of the door, which is located below the height level defined by the lower face of an upper or topmost washing basket. This improves the drying result for items for washing in the upper or topmost washing basket in a simple manner.

It may in some instances be expedient if the one or more guide structures, in particular guide elements, are configured as a single piece with a stamped and molded part forming the inner face of the door. This simplifies production technology.

According to one advantageous variant of the invention the dishwasher can have a circulation drying system serving to dry the drying fluid, in particular comprising an absorption drying element, preferably a zeolite drying element.

It is also favorable in particular for there to be a circulating facility for the forced circulation of the drying fluid.

It may in some instances be advantageous if an outflow element present in the washing compartment is provided, which is configured in such a manner that the drying fluid flowing into the washing compartment is guided at least partially with a direction component running essentially horizontally toward the inner face of the door. It may be favorable in particular here if the outflow element is disposed in the base of the washing compartment.

The advantageous configurations and developments of the invention described above and/or any others set out in the subclaims can be applied individually or in any combination with one another, except for example in instances of clear dependency or incompatible alternatives.

BRIEF DESCRIPTION OF THE DRAWINGS

The invention and its advantageous configurations and developments as well as their advantages are described in more detail below with reference to drawings, each of which shows a schematic basic outline, in which.

DETAILED DESCRIPTION OF EXEMPLARY EMBODIMENTS OF THE PRESENT INVENTION

Figure 1:
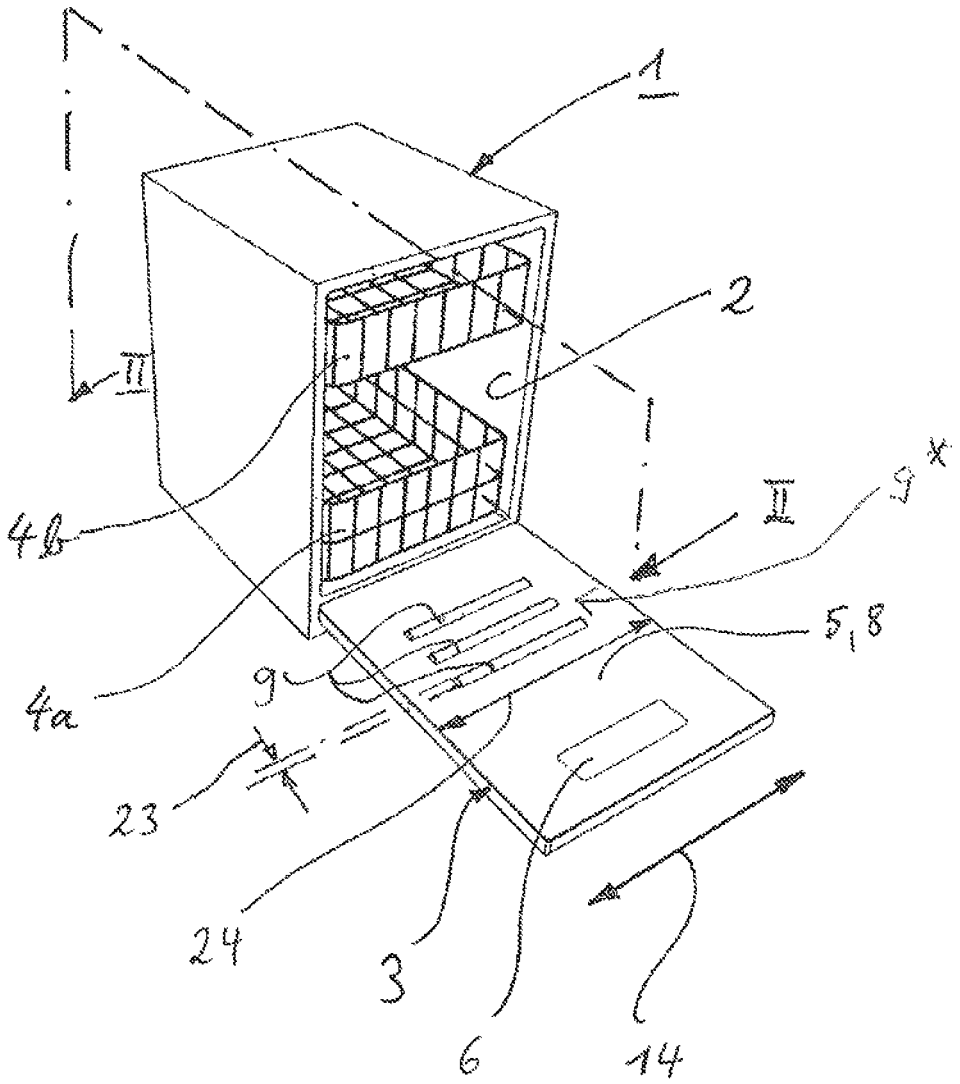
FIG. 1 shows a perspective view of a domestic dishwasher, the door of which is embodied as a whole as planar.

Elements of identical function and mode of operation are shown with the same reference characters in the figures. Only those components of a dishwasher that are necessary for an understanding of the invention are provided with reference characters and described in the figures. It goes without saying that the dishwasher can comprise further parts and assemblies.

Figure 2:
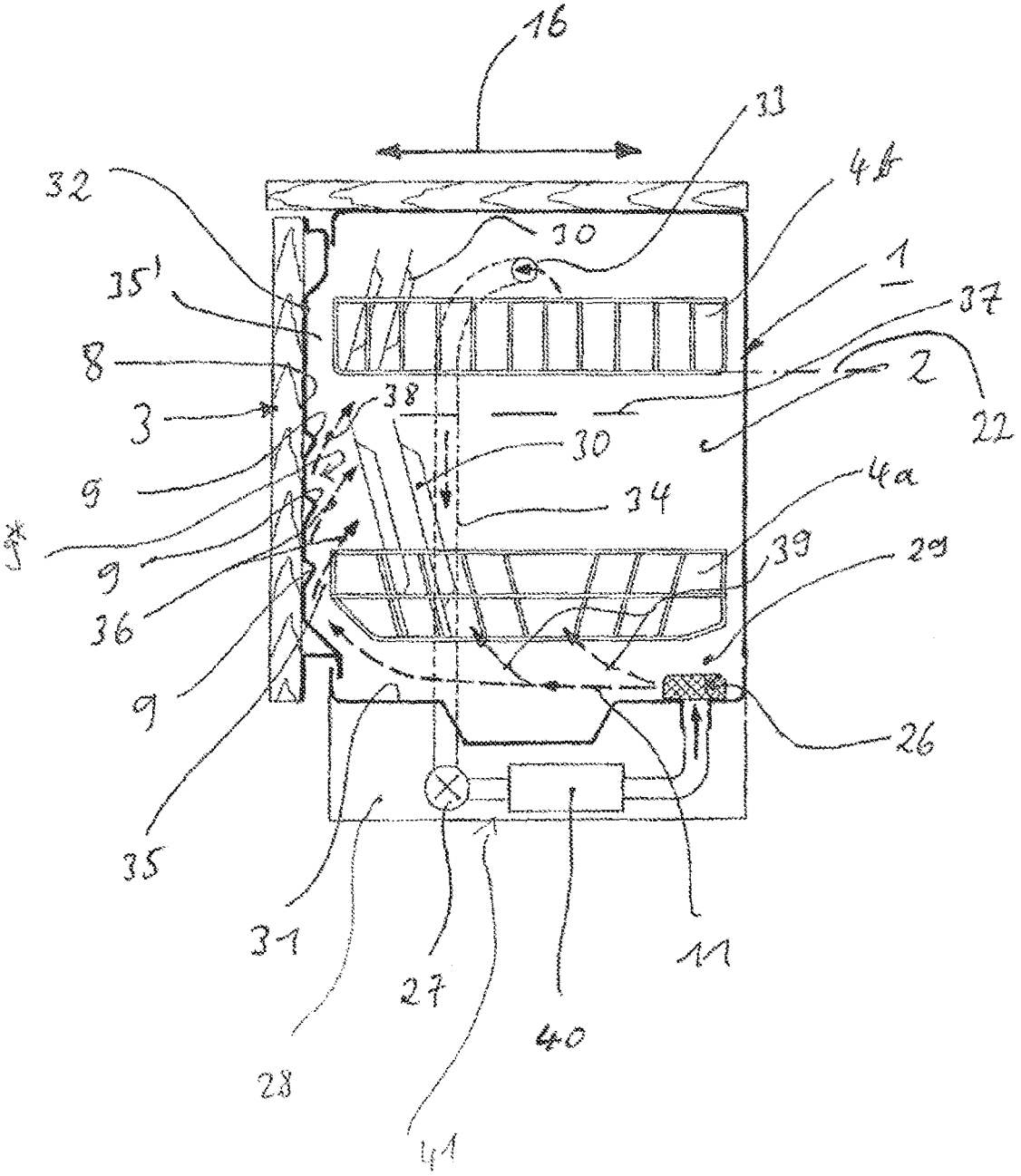
FIG. 2 shows a longitudinal section through a dishwasher according to line II-II in FIG. 1, FIGS. 3A, B show a section through a pair of guide elements spaced apart in a vertical direction, each with a different contour, according to line III-III in FIG. 5.
Figure 6:
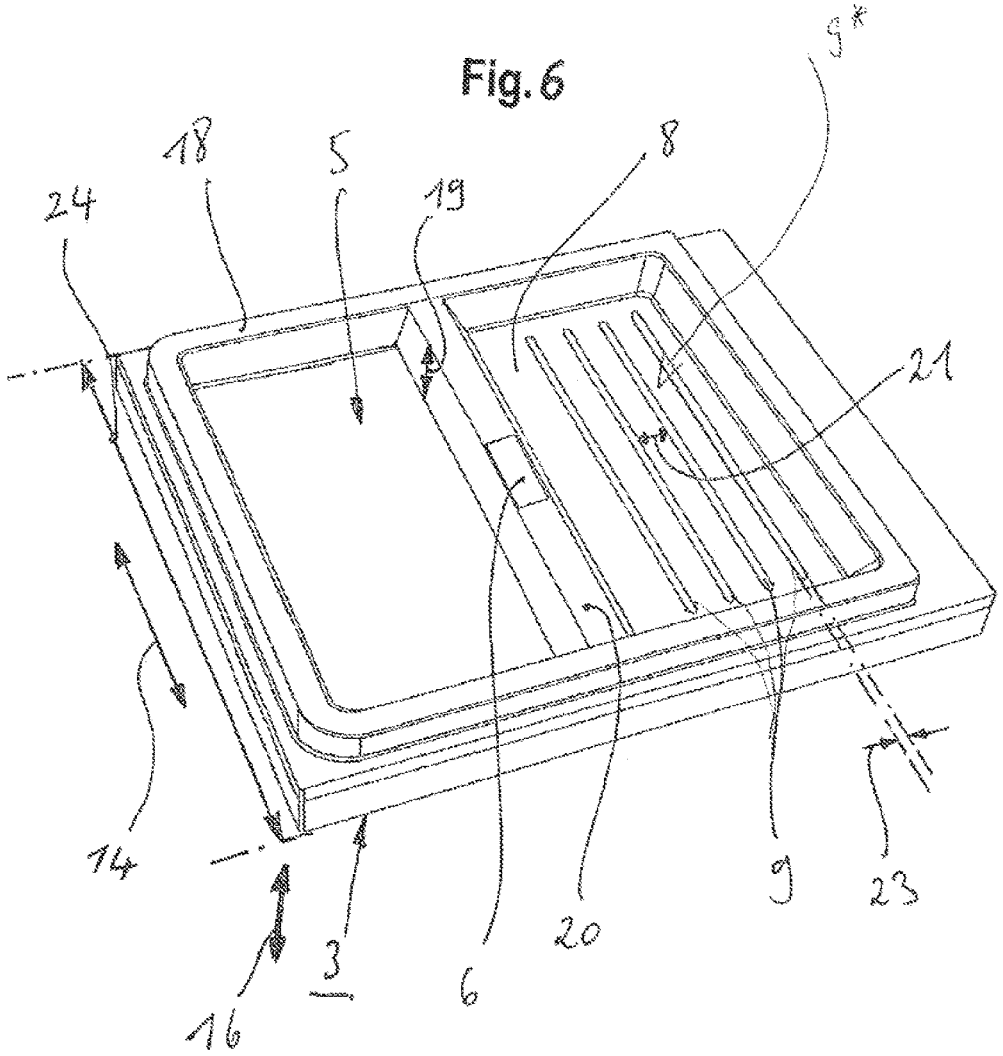
FIG. 6 shows a door according to FIG. 4, which has a holding projection extending between two lateral peripheral beads, with guide elements being present on a planar surface of the recess delimited by the holding projection and the peripheral beads.

A dishwasher 1 shown in FIGS. 1 and 2 comprises a washing compartment 2, the front loading opening of which can be closed with a front door 3, which is hinged in a pivotable manner to a lower region of the dishwasher 1. Disposed in a horizontally movable manner in the washing compartment 2 are one or more—in the illustrated example two—washing baskets 4*a*, 4*b* which serve to hold items for washing 30. Present on the upper edge of the door inner face 5 is a dispenser facility 6 for washing agents, for example cleaning agent and/or rinse aid, which is disposed for example on the upper edge of the door 3 or—as shown in FIG. 6—in a door region that is central in relation to its longitudinal extension (which runs in a heightwise direction when the door is closed). A plurality of guide elements 9 spaced apart in a vertical direction 10 project from a planar surface 8 of the door inner face 5. These extend horizontally or in the widthwise direction 14 of the door 3 or dishwasher 1. As a whole they form a guide structure 9*. If the direction here is vertical, this relates to the operating state in which the door 3 is closed. The same applies to the depthwise direction mentioned below. For the purposes of simplification such direction details are also maintained in the drawings when the door is open or horizontally oriented.

The guide elements 9 can be separate components, which are positioned on, for example bonded to, the inner face of the door 3. This may be expedient for example if the door inner face as a whole forms a planar surface 8 and is formed for example by a glass plate or plastic plate. If the door has a for example metal stamped and molded part 32 on the inside, which is frequently also referred to as an inner door, the guide elements 9 are preferably configured as a single piece with the stamped and molded part 32. They are produced for example by means of a stamping operation from the side of the stamped and molded part 32 facing toward the door front face, for example when molding the inner door using a deep-drawing procedure. The guide elements 9 are preferably all configured as ribs. In the exemplary embodiment here they each have a straight longitudinal profile in the widthwise direction of the door. They therefore extend across, in particular perpendicular to, the vertical flow direction of the drying fluid 11 rising along the door inner face and each form a spoiler or diverting element for this due to their raised projection, impressing a horizontal direction component on the drying fluid flow to deflect it in the direction of the interior of the washing compartment.

They can in some instances have different cross section shapes or contours 15 to optimize the flow profile of the drying fluid, as long as these are suitable for diverting the drying fluid in the manner described above.

Figure 3:
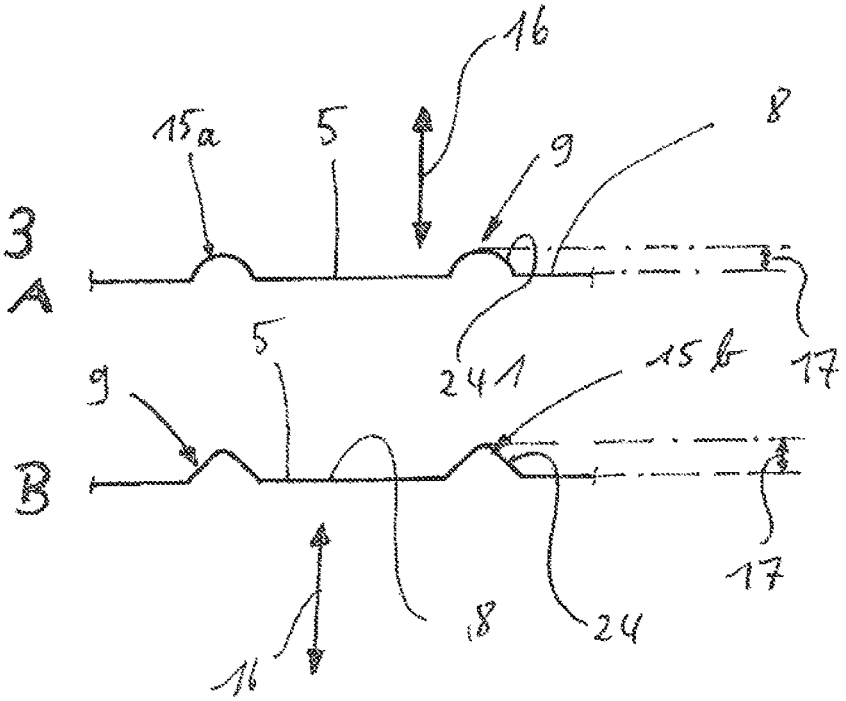
Figure 4:
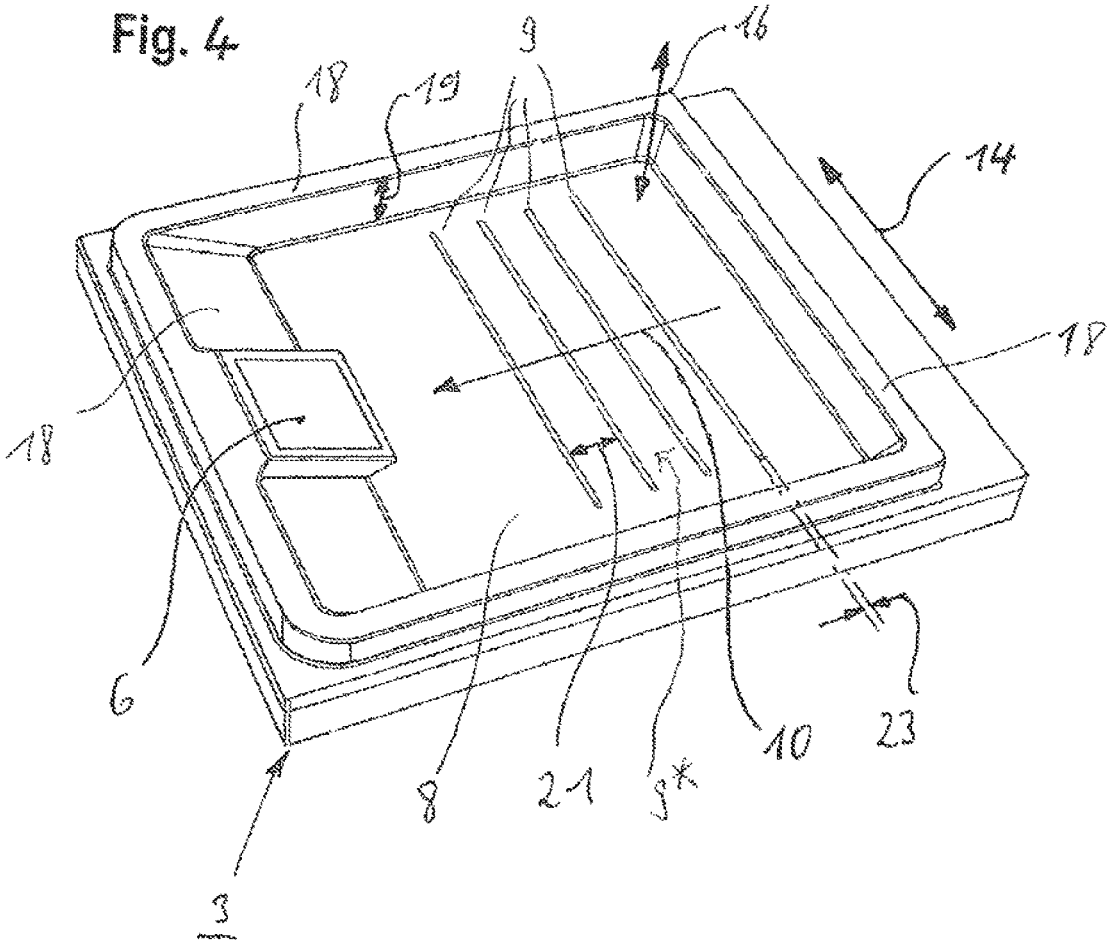
FIG. 4 shows a perspective view of a door, the inner face of which has a trough-type recess delimited by peripheral beads.
Figure 5:
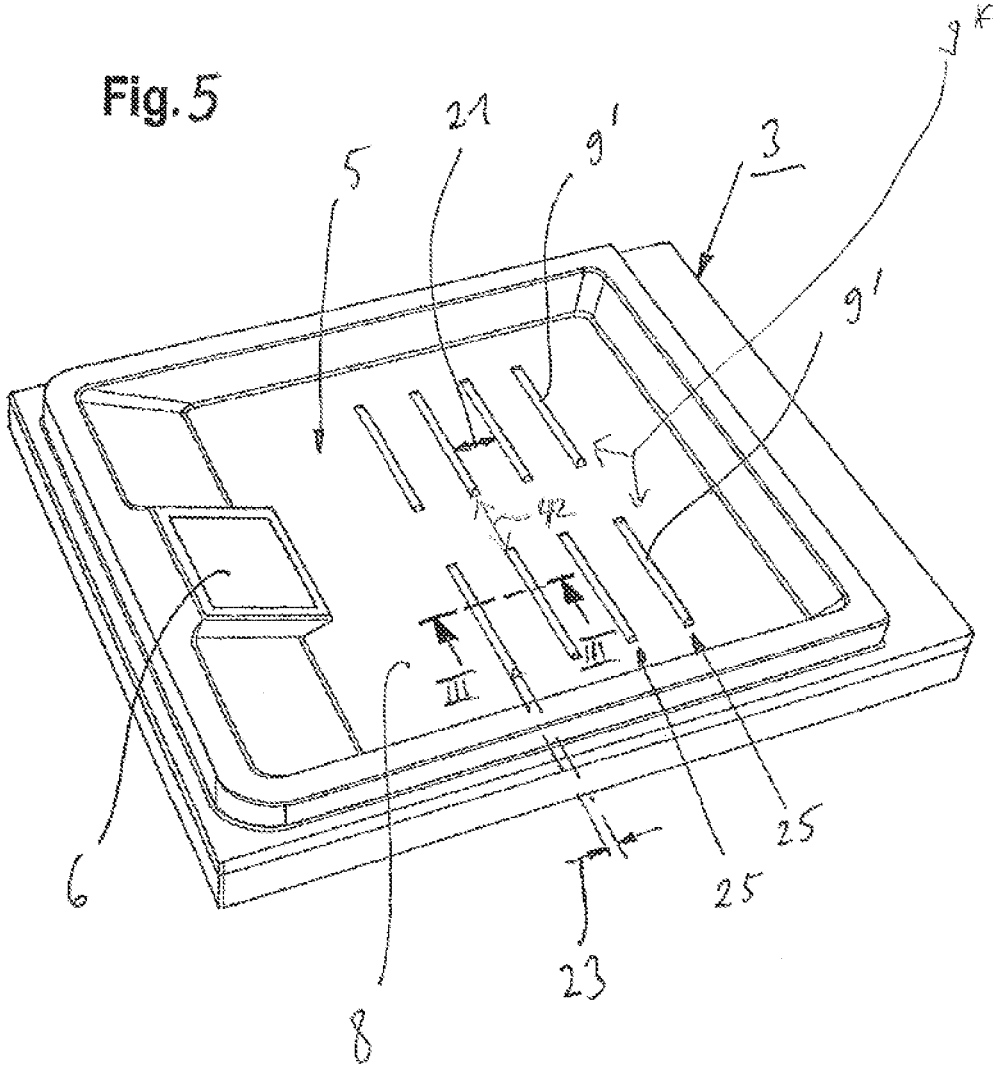
FIG. 5 shows a door according to FIG. 4 but with differently configured guide elements.

FIGS. 3A and 3B show examples of guide elements 9 with a circular contour 15*a* and a triangular contour 15*b*. A door can be provided with guide elements 9 of identical or different contour. It is therefore conceivable to select a different contour depending on the height level at which a guide element 9 is disposed on the door 3.

A further configuration feature of the guide elements 9 influencing the flow profile is their depthwise extension 17, by which they project in the depthwise direction 16 from the door inner face 5 or the planar surface 8 across, in particular perpendicular to, this. Guide elements 9 are preferably provided, the depthwise extension 17 of which is from 1 mm to 10 mm. Below 1 mm the diverting or guiding action of the guide elements is too small, so barely any appreciable improvement in the drying action can be achieved. Above 10 mm the guide element acts increasingly in the manner of a bather so that there is no flow or no longer an adequate flow of drying fluid 11 to guide elements 9 disposed downstream. The objective is however an approximately regular division of the drying fluid 11 flowing along the door inner face 5 into a number of subflows (arrows 36 in FIG. 2) directed onto the items for washing 30 or a washing basket 4*a*, 4*b* holding the items for washing. Guide elements 9, which ensure this requirement with adequate flow diversion, have a depthwise extension in the region of 3 mm to 7 mm The guide elements 9 do not necessarily have the same depthwise extension 17. Guide elements 9 of different depthwise extension 17 can be present instead. It is conceivable for example for the depthwise extension 17 to change as a function of the respective height or vertical position of the guide elements 9.

In relation to a peripheral bead 18 delimiting a trough-type recess 12 in the door inner face 5 or a holding projection 20 (FIG. 6) extending for example in the widthwise direction 14 and serving to hold a functional component, for example a dispenser facility 6, the guide elements have a comparatively small depthwise extension 17. This makes up only around 2% to 20%, preferably 5% to 15%, of the depthwise extension 19 of the peripheral bead 18 or a holding projection 20 projecting from the planar surface 8 and serving to hold a functional component, for example a dispenser facility 6.

To ensure adequate diversion of the drying fluid flow the guide elements 9 have a width in the vertical direction 10 or a vertical extension 23 that is tailored to their depthwise extension 17. The greater this is, the less steep is the flank 241 of the guide elements 9 to which the drying fluid 11 flows for a given depthwise extension. With a vertical extension of 1 mm to 20 mm, preferably 3 mm to 12, it is possible to achieve the abovementioned depthwise extensions 17 of the guide elements 9 with adequate deflection for the drying fluid flow.

A further parameter impacting on the drying fluid flow is the density with which the guide elements 9 are disposed on the planar surface 8. The greater the distance between the guide elements 9, the lower their density and vice versa. The closer the guide elements 9 are together, in other words the shorter the distance between them in the vertical direction, in other words their vertical distance 21, the smaller their diverting action, as guide elements 9 disposed downstream are as it were in the "wake" of the upstream adjacent guide element. The vertical distance 21 is therefore selected so that it is greater than the vertical extension 23 of the guide elements 9, namely 1 cm to 10 cm, preferably 2 cm to 5 cm. Compliance with said measurement ranges means that 1% to 20%, preferably 2% to 10%, of the planar surface 8 is covered with guide elements 9. A number from 2 to 8, in particular from 3 to 6, of guide elements, provided on the inner face of the door, is expediently selected to form an effective guide structure.

The guide elements 9 run in the widthwise direction 14 of the door 3, preferably extending over a region of 50% to 90% of the door width 24, to ensure an adequate diverting action.

A single guide element 9 can also extend over the above-mentioned width region or rows 25 of a number of guide elements 9' are provided. In particular a transverse gap 42 can be provided between two rows 25, provided next to one another in the widthwise direction 14 in each instance, of guide elements 9' disposed spaced apart from one another in the heightwise direction 10 and each extending in the widthwise direction 14. This allows the provision of guide structures 9* that are tailored specifically to the respective flow and structural conditions in a simple manner.

The intensity of the drying fluid flow decreases appreciably on account of diversion by the guide elements. It may therefore be expedient only to dispose the guide elements 9 on one surface region of the door inner face 5, which is located below the height level 22 defined by the lower face of the topmost washing basket **4*b* when the door 3 is closed. If there are two or three washing baskets 4 disposed one above the other, it is therefore expedient only to dispose guide elements 9 in the lower two thirds of the door inner face 5**.

The drying process in an inventive dishwasher 1 is described in more detail with reference to FIG. 2. The drying fluid 11 flows through an outflow element 26 disposed on the base 31 of the washing compartment 2 into the washing compartment 2 and is subjected to a forced flow, which is produced for example by a circulating facility 27, for example a fan, which is expediently positioned in the plinth compartment 28 of the dishwasher 1. The outflow element 26 is configured in such a manner that the drying fluid flow leaving it is directed toward the inner face 5 of the door 3, in such a manner that at least a subflow of the drying fluid 11 strikes the door inner face 5 in the region of the bottommost washing basket **4*a*. The outflow element 26 is preferably disposed on the rear end 29 of the base 31 of the washing compartment away from the door 3. This ensures that the majority of the drying fluid 11 flows upward (arrows 39) through the lower face of the bottommost washing basket 4*a*, thereby drying items for washing 30 present in the washing basket 4*a* and in the washing basket 4*b* above it. Present at a height level above the upper washing basket 4*b* in a washing compartment side wall is an outlet 33, by way of which the drying fluid 11 is taken in and fed back to the outflow element 26 by way of a line 34. Disposed downstream of the circulating facility 27 is a liquid-absorbing element, in particular a zeolite drying element 40, which extracts water from the drying fluid 11. The drying element 40, the circulating facility 27, the outflow element 26, the outlet 33 and their connecting lines are components of an air circulation system 41**.

As stated above, some of the drying fluid 11 flows toward a lower region of the door inner face 5 and is diverted vertically upward in the process, with the drying fluid 11 first flowing through a free space 35 present between the lower washing basket **4*a* and the door inner face 5. The guide elements 9 present there on the door inner face 5 or the planar surface 8 guide the drying fluid flowing through the free space 35 onto the items for washing 30 disposed closest to the door (see arrows 36). The topmost guide element 9*a* is positioned in the region of the maximum loading height 37 of the washing basket 4*a*, diverting drying fluid 11 over the items for washing 30 toward the lower face of the upper washing basket 4*b* (see arrow 38). No guide elements 9 are preferably disposed in the free space 35' between the upper washing basket 4*b* and the inner face 5 of the door 3**, as they would only improve the drying result to a small extent.

To summarize, one or more guide elements projecting in relation to the trough base are also expediently provided for air deflection or air guidance in the planar or smooth trough base of the inner door, which is enclosed by a peripheral bead around it. The guide elements are preferably impressed or shaped, in particular stamped (using stamping procedures), or shaped by hydraulic molding, from the outside in, in other words in the direction of the face facing the treatment chamber, in the case of a metal inner door wall. They are additionally provided on the otherwise planar surface of the inner door and project therefrom. If required the peripheral bead of the inner door can be omitted with some dishwasher variants. The raised guide elements can each be configured as a linear or narrow strip-type rib or web, running in the widthwise direction of the inner door. A number of, in particular between 3 and 6, guide elements are respectively disposed above one another at a predeterminable vertical distance. This plurality of guide elements forms a guide structure in stack form. Alternatively a guide structure can in some instances also be configured as a logo, symbol, character set, etc. The one or plurality of protruding structures serve to guide and deflect air in a specific manner to a desired region in the interior of the washing compartment. Normally, in other words without additional air guide elements, an air flow in the gap or free space between the wall of the inner door facing the interior of the washing compartment and the front faces of the two racks in the vertical direction (in particular from bottom to top in the exemplary embodiments in FIGS. 1 to 6) would remain largely unused for passing along and therefore for drying items for washing in the one or more washing baskets, in particular racks. In some circumstances too little air would reach the items to be dried that are held in the interior of the respective rack. In particular too little air flow, in other words moving air, would enter the space between the lower basket and the upper basket so that it would not be possible to ensure an adequate air supply to the items for washing in the upper basket from below.

In order to be able to ensure the most regular supply of air possible to as many regions as possible of the respective washing basket, in particular of the upper rack, for the most regular drying possible of the items for washing held there in the drying cycle of the respective dishwasher program, the additional one or more projecting or protruding guide elements or profile elements are now provided on the otherwise smooth, in other words planar, inner door surface. This ensures a better air supply to the items for washing in the washing baskets, for example in the upper rack and/or in a flatware drawer disposed above it. The guide elements are provided in addition to the structural components normally present, for example an integrated projection for a cleaning agent/rinse aid dispenser present in the region of an upper peripheral zone of the door. They guide the air to regions of the one or more washing baskets, in particular racks, which are filled with items for washing. They therefore serve to distribute or guide air in a specific, in other words intentionally forced, manner from the front air shaft on the front face between the washing baskets and the inner door surface into the interior of the treatment chamber, in particular into the interior of the respective washing basket.

In some instances the air can preferably be guided/directed to a specific zone of the respective washing basket, in particular rack, which is provided for items for washing, in particular dishes, having particular requirements for drying performance. This can be for example a region of the washing basket, which is provided specifically for plastic dishes which are more difficult to dry than ceramic or porcelain due to their lack of mass.

The guide elements or more generally the guide structures preferably protrude between 1 mm and 10 mm, in particular between 3 and 7 mm, from the planar or flat inner surface of the inner door facing the interior of the washing compartment. (More is not expedient, as the air flow path between the inner door wall and the front face of the racks cannot be too restricted so as to avoid breaking up the air circulation in the interior of the washing compartment). The projection of the one or more guide structures from the planar inner surface of the inner door is in each case flat compared with any integrated projection for the cleaning agent/rinse aid dispenser. The respective guide structure is also much flatter than a peripheral bead, which often encloses the trough in the door in many door structures. When the door is fully closed in the vertical position, the respective guide structure preferably has an extension protruding from its door trough in the depthwise direction of between 2% and 20% of the depthwise extension of the peripheral bead.

The one or more guide structures, in particular their guide elements, are preferably provided on the lower ⅔ of the door inner wall. The upper third of the door remains free of guide structures (when viewed in the heightwise direction with the door in the vertical position). An air flow, which rises upward from the region of the washing compartment close to the base, can then be adequately divided in a timely manner before reaching the top wall of the washing compartment, in particular before reaching the upper basket, and be deflected into the interior of the washing compartment with a flow component in the depthwise direction. This in particular ensures that the air supply to the upper basket from below is improved. The one or more guide structures are preferably distributed over 1% to 20%, in particular between 2% and 10%, of the inner wall surface of the door.

If there are a number of guide elements, in particular guide ribs or guide webs, running across the inner door face, in other words extending in the widthwise direction of the inner door, they are preferably disposed in an essentially parallel manner and at a heightwise distance from one another (in relation to the vertical closed position of the door). The heightwise or vertical distance between two adjacent guide elements in each instance is in particular greater than the heightwise extension of the respective guide element (height in relation to the vertical final closed position of the door). The heightwise distance from one guide rib to the next guide rib is preferably selected to be between 1 cm and 10 cm, in particular between 2 cm and 5 cm. The heightwise extension of the respective guide element (in other words its width when viewed in the heightwise direction of the door in its vertical closed position) is preferably selected to be between 1 mm and 20 mm, in particular between 3 mm and 12 mm.

The widthwise extension of the respective guide element when viewed in the widthwise direction of the inner door is selected to be between 50% and 90% of the overall width of the door. Between 2 and 8, in particular between 3 and 6, guide elements are expedient in order to be able to bring about adequate diversion and redistribution of the air flow away from the door inner face into the interior of the washing compartment. It may be expedient in particular if the guide elements are provided in the planar surface of the inner door distributed along the heightwise extension of the lower basket (from its bottom edge to its top edge), in order to be able to force the front air flow as it draws upward into the intermediate gap between lower basket and upper basket.

The invention claimed is:

1. A dishwasher, comprising:

a washing compartment, a plurality of washing baskets including a bottommost washing basket and at least one upper washing basket disposed in the washing compartment and configured to hold items for washing, a door configured to close the washing compartment and having a planar surface to form an inner face of the door as a whole or a part thereof, an outflow element placed in the washing compartment and configured to guide a flow of a drying fluid in a drying mode into the washing compartment at least partially with a direction component running essentially horizontally toward the inner face of the door along a base of the washing compartment, and a guide structure projecting in a raised manner from the planar surface into an interior of the washing compartment and disposed so as to guide the drying fluid flowing heightwise along the inner face of the door onto the items in the washing compartment when the dishwasher is in the drying mode and the door assumes a closed position, wherein the guide structure comprises a plurality of individual guide elements, and wherein the guide elements are placed in the closed position of the door on the inner face in vertical spaced-apart relation, such that a topmost guide element of the plurality of individual guide elements is positioned in a region of a maximum loading height of the bottommost washing basket, thereby to direct the flow of the drying fluid toward the bottommost washing basket and the at least one upper washing basket.

2. The dishwasher of claim 1, constructed in the form of a domestic dishwasher.

3. The dishwasher of claim 1, wherein each of the guide elements has a vertical extension, with a vertical distance between two adjacent ones of the guide elements being greater than the vertical extension.

4. The dishwasher of claim 3, wherein the vertical distance is 1 cm to 10 cm.

5. The dishwasher of claim 3, wherein the vertical distance is 2 cm to 5 cm.

6. The dishwasher of claim 1, wherein the guide elements run essentially parallel to one another.

7. The dishwasher of claim 1, wherein the each of the guide elements is configured in the form of guide rib extending in a widthwise direction of the door.

8. The dishwasher of claim 7, wherein the guide rib is linear.

9. The dishwasher of claim 1, wherein each of the guide elements has a vertical extension of 1 mm to 20 mm when viewed with the door in the closed position.

10. The dishwasher of claim 1, wherein each of the guide elements has a vertical extension of 3 mm to 12 mm when viewed with the door in the closed position.

11. The dishwasher of claim 1, wherein the guide structure, when viewed with the door in the closed position, has a depthwise extension of 1 mm to 10 mm by which the guide structure protrudes from the planar surface of the inner face into the interior of the washing compartment.

12. The dishwasher of claim 1, wherein the guide structure, when viewed with the door in the closed position, has a depthwise extension of 3 mm to 7 mm by which the guide structure protrudes from the planar surface of the inner face into the interior of the washing compartment.

13. The dishwasher of claim 1, wherein the inner face of the door has a trough-shaped recess delimited by a peripheral bead.

14. The dishwasher of claim 13, wherein the guide structure has a depthwise extension which is 2% to 20% of a depthwise extension of the peripheral bead of the door and/or a holding projection projecting from the planar surface of the inner face of the door and serving to hold a functional component.

15. The dishwasher of claim 13, wherein the guide structure has a depthwise extension which is 5% to 15% of a depthwise extension of the peripheral bead of the door and/or a holding projection projecting from the planar surface of the inner face of the door and serving to hold a functional component.

16. The dishwasher of claim 1, wherein the guide structure is configured to cover 1% to 20% of the planar surface of the inner face of the door.

17. The dishwasher of claim 1, wherein the guide structure is configured to cover 2% to 10% of the planar surface of the inner face of the door.

18. The dishwasher of claim 1, wherein the guide structure is configured to extend over 50% to 90% of a width of the door.

19. The dishwasher of claim 1, wherein the guide structure is disposed in a lower two thirds of the inner face of the door.

20. The dishwasher of claim 1, wherein the at least one upper washing basket is a topmost washing basket, said guide structure being disposed on a surface region of the inner face of the door, said surface region being located below a height level defined by a lower face of the topmost washing basket.

21. The dishwasher of claim 1, wherein a number of the guide elements provided on the inner face of the door is between 2 and 8.

22. The dishwasher of claim 1, wherein a number of the guide elements provided on the inner face of the door is between 3 and 6.

23. The dishwasher of claim 1, wherein the inner face of the door is formed by a stamped and molded part, said guide structure being configured as a single piece with the stamped and molded part.

24. The dishwasher of claim 1, further comprising a circulation drying system configured to dry the drying fluid.

25. The dishwasher of claim 24, wherein the circulation drying system includes an absorption drying element.

26. The dishwasher of claim 25, wherein the absorption drying element is a zeolite drying element.

27. The dishwasher of claim 1, further comprising a circulating facility for a forced circulation of the drying fluid.

28. The dishwasher of claim 1, wherein the outflow element is disposed in the base of the washing compartment.

* * * * *